US010344434B2

(12) United States Patent
Szekely et al.

(10) Patent No.: US 10,344,434 B2
(45) Date of Patent: Jul. 9, 2019

(54) DETECTABLE WARNINGS

(71) Applicants: Kenneth E. Szekely, Oakville (CA); David N. Sambrook, Toronto (CA); John A. Heffner, Clarksburg, CA (US)

(72) Inventors: Kenneth E. Szekely, Oakville (CA); David N. Sambrook, Toronto (CA); John A. Heffner, Clarksburg, CA (US)

( * ) Notice: Subject to any disclaimer, the term of this patent is extended or adjusted under 35 U.S.C. 154(b) by 0 days.

(21) Appl. No.: 15/295,660

(22) Filed: Oct. 17, 2016

(65) Prior Publication Data

US 2017/0096784 A1 Apr. 6, 2017

Related U.S. Application Data

(62) Division of application No. 14/349,549, filed as application No. PCT/IB2012/002902 on Oct. 3, 2012, now abandoned.

(60) Provisional application No. 61/542,532, filed on Oct. 3, 2011.

(51) Int. Cl.

| | |
|---|---|
| ***E01C 9/00*** | (2006.01) |
| ***E01C 15/00*** | (2006.01) |
| ***E01C 11/00*** | (2006.01) |
| ***E01C 5/00*** | (2006.01) |
| ***A61H 3/06*** | (2006.01) |

(52) U.S. Cl.

CPC ..... *E01C 9/00* (2013.01); *A61H 3/066* (2013.01); *E01C 5/00* (2013.01); *E01C 11/00* (2013.01); *E01C 15/00* (2013.01); *E01C 5/003* (2013.01); *E01C 9/002* (2013.01)

(58) Field of Classification Search

CPC ..... A61H 3/066; E01C 9/00

USPC ..... 116/205; D25/138

See application file for complete search history.

(56) References Cited

U.S. PATENT DOCUMENTS

| | | | | |
|---|---|---|---|---|
| 272,629 | A * | 2/1883 | Beeching | E04B 5/46 404/22 |
| 4,080,087 | A * | 3/1978 | Phillips | A61H 3/066 116/205 |
| 5,217,319 | A | 6/1993 | Klohn | |
| 5,277,513 | A * | 1/1994 | Flanagan | E01F 9/553 404/16 |
| 6,074,127 | A * | 6/2000 | Suetsugu | E01C 9/086 404/36 |
| 6,234,712 | B1 * | 5/2001 | Flader | E01F 9/553 116/63 R |
| 6,450,728 | B1 | 9/2002 | Grahmbeek et al. | |
| 7,955,024 | B2 | 6/2011 | Driscoll et al. | |
| 7,992,360 | B2 | 8/2011 | Driscoll | |
| 8,082,872 | B2 * | 12/2011 | Cook | A61H 3/066 116/205 |
| 8,544,222 | B2 * | 10/2013 | Sippola | A61H 3/066 52/177 |
| 8,905,057 | B2 * | 12/2014 | Sass | A47L 15/4212 137/15.11 |
| 9,151,057 | B2 * | 10/2015 | Mills | E04D 13/1475 |
| 2006/0245827 | A1 | 11/2006 | Rydin et al. | |
| 2008/0107481 | A1 | 5/2008 | Donald et al. | |

(Continued)

FOREIGN PATENT DOCUMENTS

EP 2261438 A1 12/2010

*Primary Examiner* — Thomas B Will
*Assistant Examiner* — Katherine J Chu
(74) *Attorney, Agent, or Firm* — Stephen Kenny; Foley Hoag LLP

(57) ABSTRACT

Methods, systems and devices for detectable warnings are disclosed.

9 Claims, 13 Drawing Sheets

(56) References Cited

U.S. PATENT DOCUMENTS

| | | | | |
|---|---|---|---|---|
| 2008/0280097 | A1 | 11/2008 | Flaherty et al. | |
| 2012/0207543 | A1* | 8/2012 | Sippola ..... | A61H 3/066<br>404/42 |
| 2012/0275858 | A1 | 11/2012 | Szekely et al. | |

* cited by examiner

SECTION A–A

DETAIL B

DETECTABLE WARNINGS

RELATED APPLICATIONS

This application is a Divisional application and claims the benefit under 35 U.S.C. § 121 of U.S. application Ser. No. 14/349,549 filed Oct. 3, 2012; which is a National Stage application under 35 USC § 371 of PCT/IB2012/002902; which further claims the benefit of priority under 35 U.S.C. § 119 to U.S. Provisional Application No. 61/542,532 filed Oct. 3, 2011.

SUMMARY

Methods, systems and devices for detectable warnings are disclosed.

DETAILED DESCRIPTION

FIGS. 1-4 show detectable warning tiles. The upper surface of such a tile includes detectable warnings, in this case truncated domes as specified by Americans with Disabilities Act Accessibility Guidelines. The tile is designed to warn the visually impaired that they are approaching a hazard, and so can be installed, for example, at the edge of train platform or at a curb ramp where a pedestrian walkway meets a road.

The tiles of FIGS. 1-4 are designed to be installed in wet concrete. In each case, the unit is assembled by attaching anchors to the tile using fasteners, e.g., screws, as shown. Once the anchors are attached to the tile, the entire unit may be pressed into wet concrete so that some surface of the tile is flush with the surrounding walking surface, while the truncated domes protrude upward to allow for tactile detectability. In this way, the truncated domes will protrude above the walking surface so as to provide a tactile warning to visually impaired pedestrians.

The anchors are formed with a bottom portion that is wider that at least some other portion of the anchor. Once the concrete cures and hardens, the wider, lower portion will be locked in place vertically by the hardened concrete. In some cases, anchors are formed so that the hardened concrete will lock the anchor in place horizontally as well. As shown in the figures, some anchors are formed with a polygonal, e.g., hexagonal, horizontal cross-section. Because this part of the anchor is not circular, the cured, hardened concrete will prevent the anchor from spinning about a vertical axis. The anchor may also include vertical protrusions that similarly prevent the anchor from spinning.

Figure 1A:
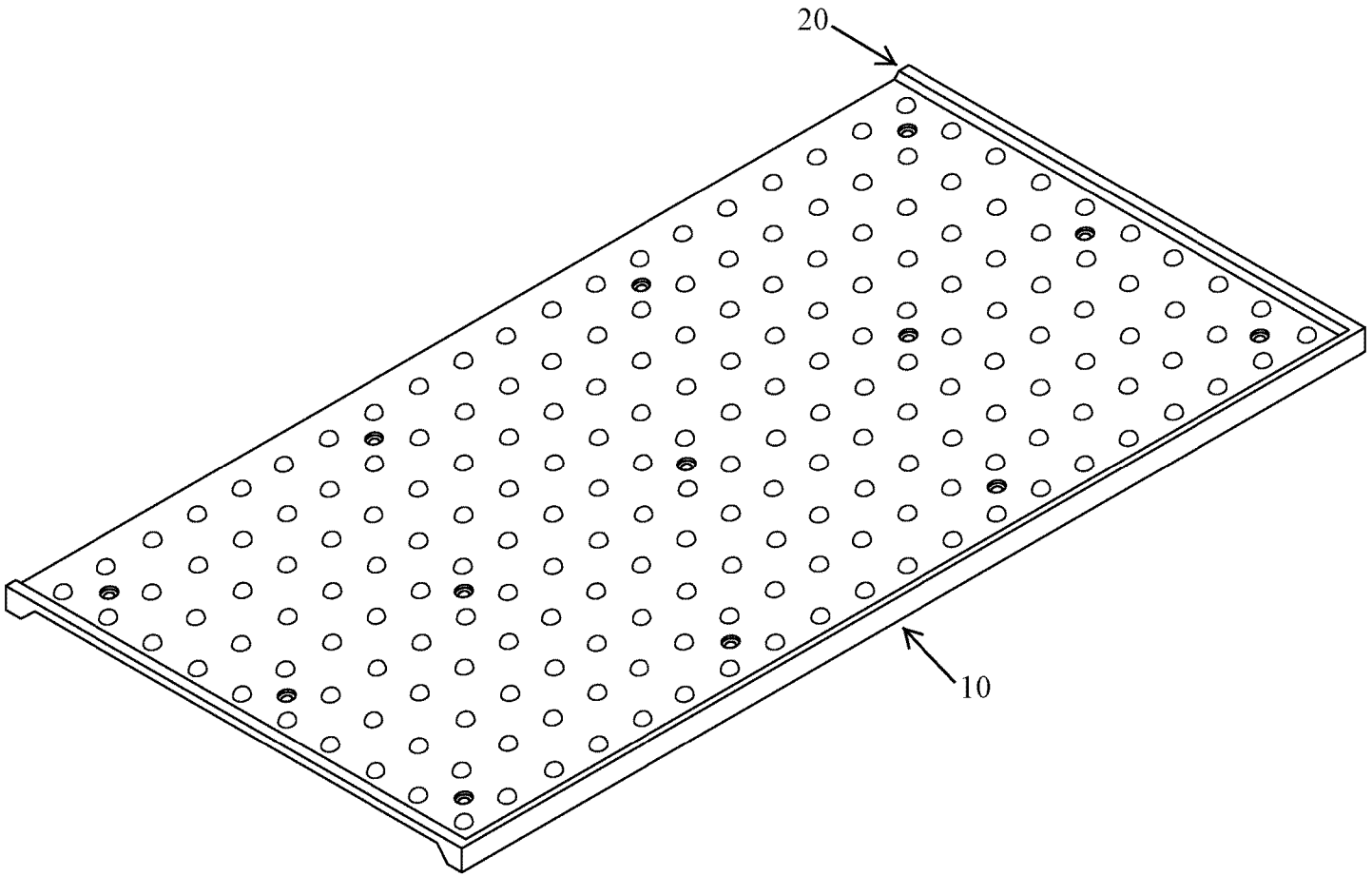
FIG. 1A is a schematic picture of a replaceable detectable warning tile with a protective upper lip and lower flanges on two opposing edges but not on the other two edges.
Figure 1B:
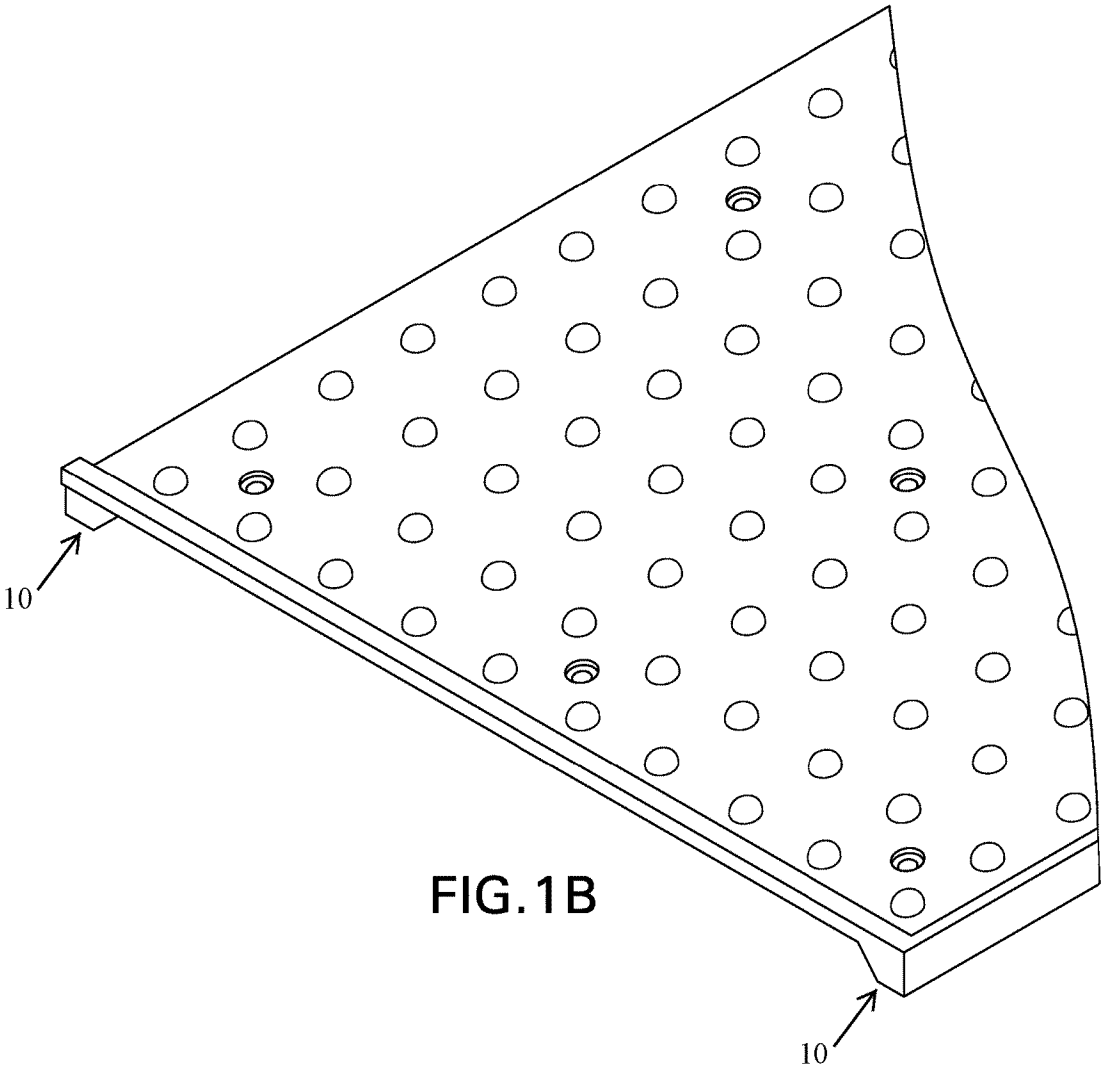
FIG. 1B is a close up schematic picture of the same tile depicted in FIG. 1A.
Figure 1C:
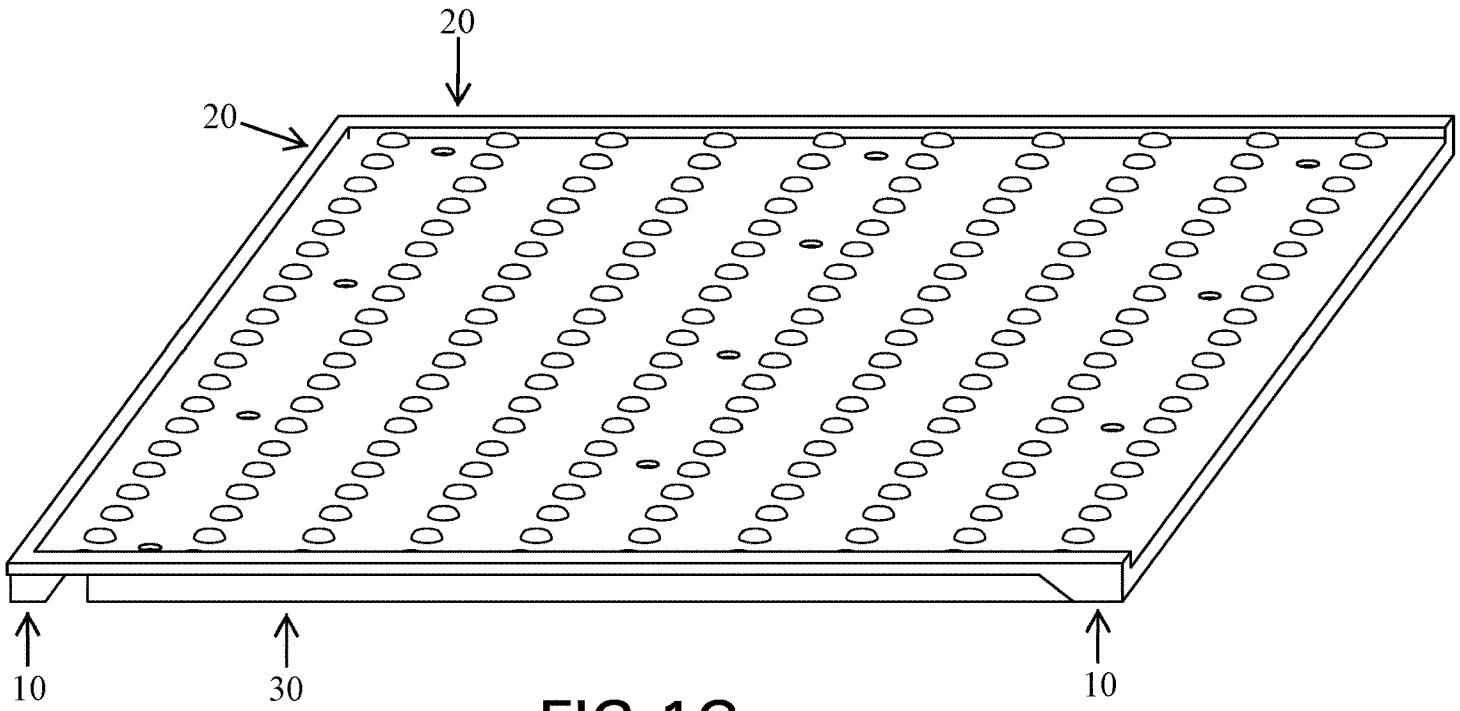
FIG. 1C is a schematic picture of the same tile depicted in FIG. 1A looking along the long axis of the tile.
Figure 1D:
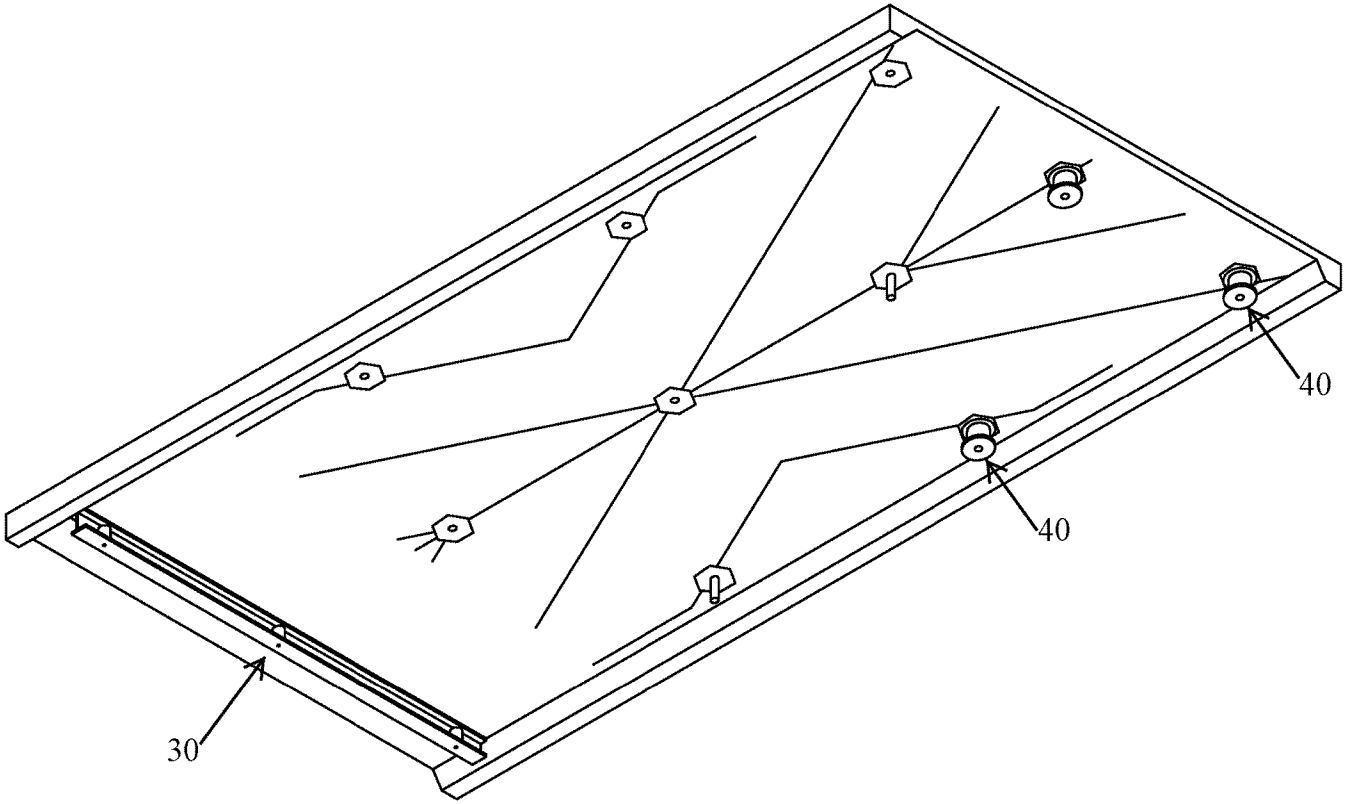
FIG. 1D is a schematic picture of the same tile depicted in FIG. 1A looking from underneath.

FIGS. 1C and 1D also show a different type of anchor that mimics a rib on the underside of the tile. This rib-anchor is fastened to the tile by multiple fasteners at different locations unlike the single-fastener, hexagonal anchors also shown. Ribs can be used to provide stiffness or strength to the tile, and the multi-fastener anchor can mimic those effects.

The tile is attached to the anchors by the fasteners. If the fasteners are removed, the tile can be removed leaving the anchors in place in the concrete. The tile can be removed because it is shaped or otherwise formed so that the cured concrete does not lock it in place. To the extent that the tile protrudes downward into the concrete, and to the extent that such downward protrusions vary in width as a function of height, the protrusions should be narrower, or at least not broader, the lower they go (except in the isolation tray embodiment described below).

Such replaceable detectable warning tiles can have a number of problems which are addressed by inventions disclosed herein.

Preventing Buckling

A first problem is buckling. Because the tile is typically not made out of the same material as the substrate in which it is installed (e.g., polymer composite tile vs. concrete substrate), the tile and the substrate may have different thermal expansion properties. When the tile is installed and the concrete cures, the void in the concrete formed by the tile will conform to the tile precisely. But as the temperature varies, the expansion or contraction of the concrete will change the shape of the void into which the tile must fit. At the same time, the size of the tile will also change due to thermal expansion, and it will do so at a different rate than the concrete. If the tile becomes too large for the space in the concrete into which the tile must fit, the unit must somehow deform and may buckle.

Similarly, when the tile is installed and the concrete cures, the anchors are aligned with attachment points on the tile where the anchors are fastened to the tile. As the temperature varies, it is the thermal expansion of the concrete that determines the location of the locked-in anchors, while the thermal expansion of the tile determines the location of the attachment points. If the tile and concrete expand at different rates, the anchors may cease to be well-aligned with their attachment points. This too may cause the tile to buckle.

Generally, buckling may be prevented or reduced by reducing the interaction of flanges on the tile with the underlying concrete. In particular, the FIGS. schematically depict several ways of addressing the problem of buckling.

FIG. 1A shows schematically a tile with underside flanges on only two opposing sides, with the other two opposing sides left without any flange. Some wet-set, replaceable, detectable warning tiles have underside flanges on all (typically four) sides of the tile. By leaving some sides of the tile with no underside flange, buckling may be reduced. In particular, FIG. 1A shows a tile with a long direction, presumably perpendicular to the direction in which pedestrian will walk over the tile, and a short direction, parallel to the direction of pedestrian traffic. In FIG. 1A, the tile has underside flanges on the long sides, running perpendicular to the direction pedestrian traffic, and no flanges on the short sides parallel to pedestrian traffic. As shown in detail in FIG. 1B, the underside flanges are separated by the shorter horizontal dimension of the tile. Longer flanges separated by the shorter direction of the tile may cause less buckling than shorter flanges separated by the longer direction of the tile. But in either case, leaving one or more sides with no flange, may reduce buckling. More generally, a tile may reduce buckling where at least one, in some cases both, of two opposing sides has no flange.

The flanges may extend from the outermost vertical surface of the tile unit, or, as shown, the tile may extend horizontally beyond the flange. The tile need not be rectangular. For example, the tile could have an arcuate shape, or trace out an angular sector of an annulus. The tile also need not be a quadrilateral, even a curvilinear quadrilateral; the tile may have more than four or fewer than four edges.

Figure 2:
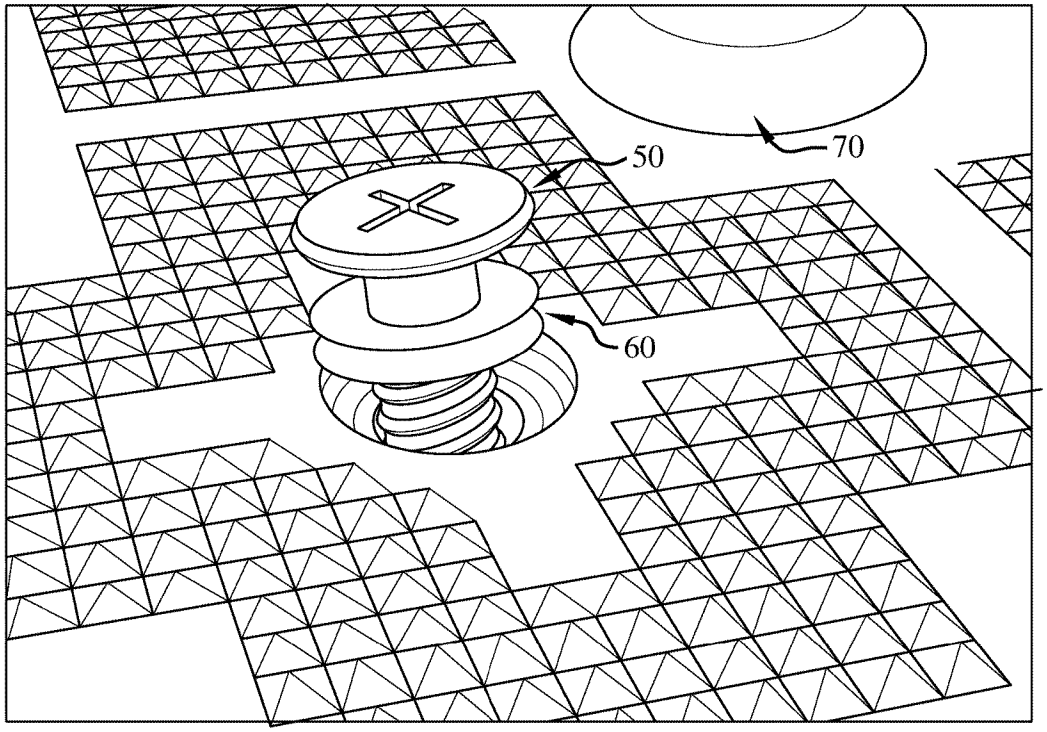
FIG. 2 is a photograph of an example of a tile including a flexible grommet surrounding a fastener.

Another way of reducing the problem of buckling is to allow the anchors and/or fasteners to move relative to the tile. Since the anchors are locked into the concrete, they will necessarily move differently due to the thermal expansion than the points on tile to which the anchors are attached, e.g., the holes for the fasteners. FIG. 2 shows a flexible grommet that fits around the fastener, which, in this case, is a screw. The fastener is rigidly fixed to the anchor, but because the grommet is flexible and compressible, the fastener can move relative to the tile without forcing the tile to deform; the grommet is deformed instead. Some previous detectable warning tiles have used fasteners with heads that are designed to mate closely with the hole in the tile, e.g., a screw with a countersink head that mates with a conical hole in the tile. In employing the present idea, it is important that the fastener does not mate so closely with the tile that it becomes impossible for the fastener to move relative to the tile. Thus, the screw shown in FIG. 2 is a flat-head screw and the tile is cut to leave room for the head of the screw to move relative to the tile.

Alternatively, the fastener may be fixed to the tile, but allowed to move slightly relative to the anchor. The anchor may be made of some flexible material that allows the fastener to move slightly with the tile while the anchor stays fixed in the concrete.

In any case, the amount of relative thermal expansion or contraction allowed may be the amount of expansion or contraction associated with a specific change in temperature of the tile, for example 1, 2, 3, 4, 5, 10, 15, 20, 25, 30, 40 or 50 degrees centigrade.

Figure 3:
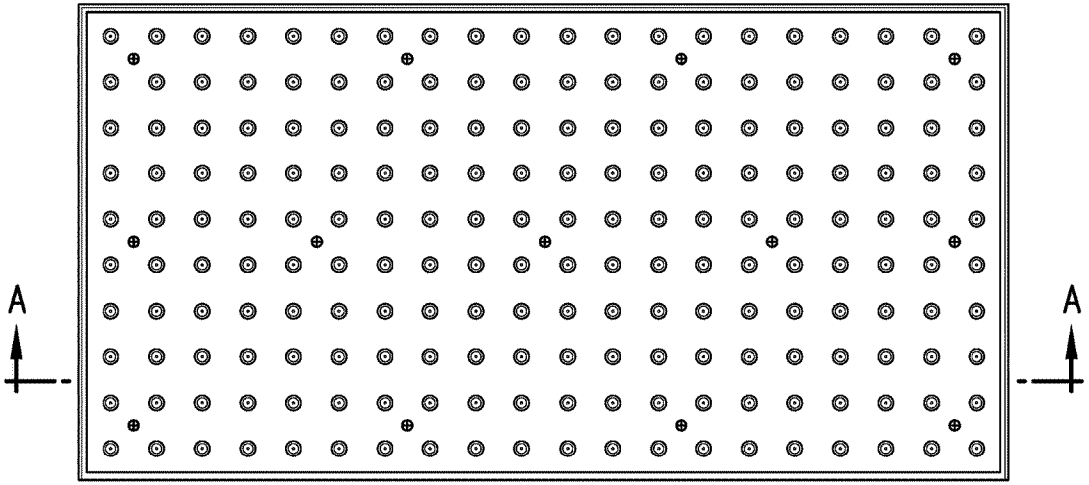
FIG. 3 is a series of schematic drawings of a tile assembly including an isolation tray.
Figure 3A:
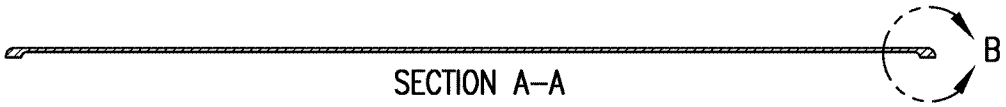
Figure 3B:
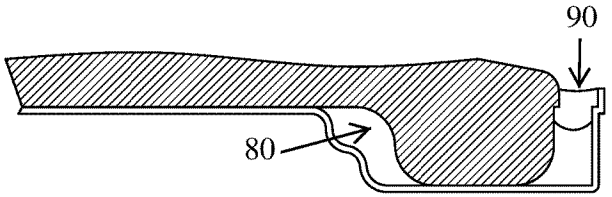
Figure 3C:
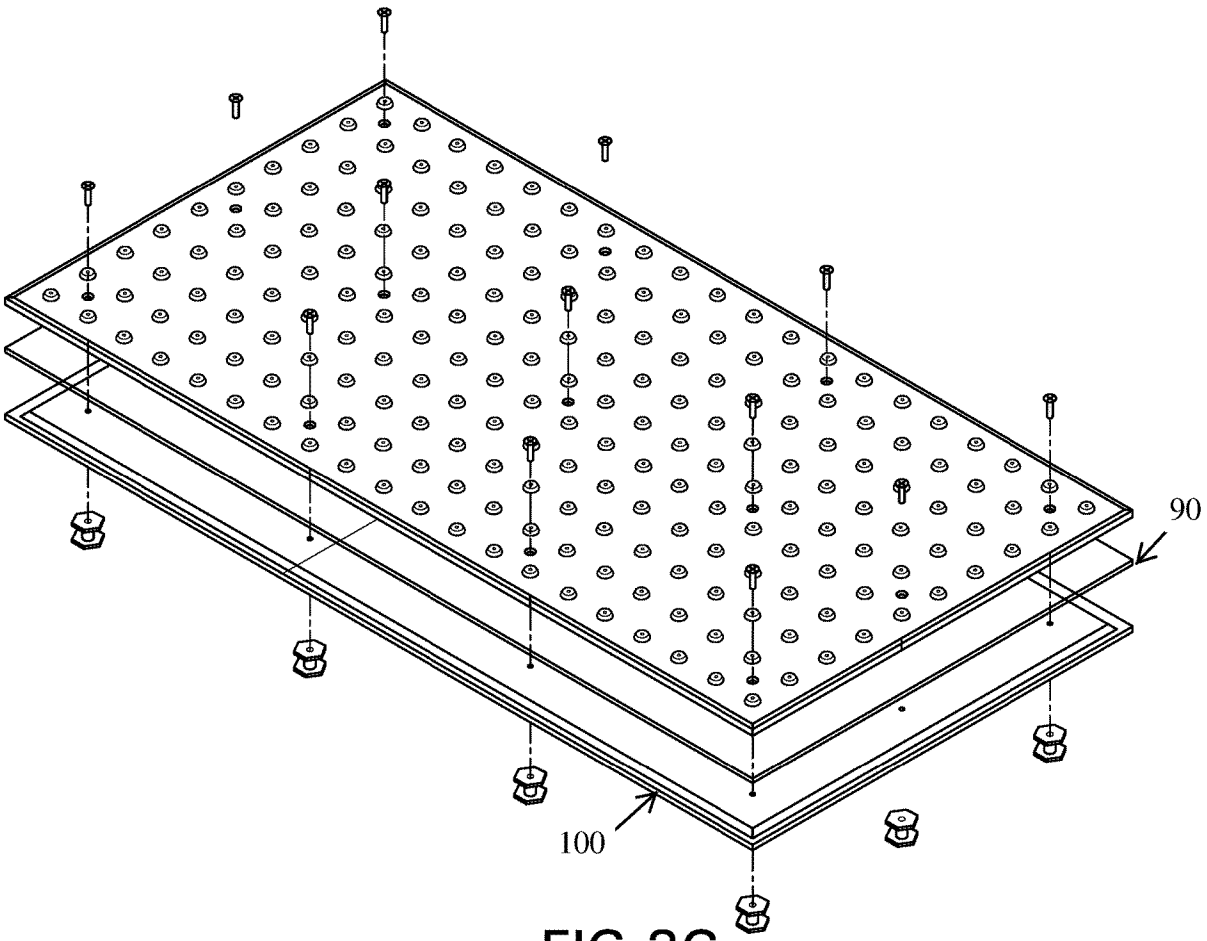

FIG. 3 shows yet another way of addressing the problem of buckling, by installing the tile in an isolation tray. In this embodiment, a tray is affixed to the tile. The fasteners pass through the tile, through the tray and then into the anchors. The isolation tray is larger than the tile, leaving room for the tile to expand and contract horizontally inside the tray. An exposed gap between the tray and the tile can be sealed, for example with a flexible caulking that allows for expansion and contraction of the tile while preventing debris from falling into the tray. The presence of the tray leaves a horizontal gap between the tile and the surrounding concrete, allowing the tile to expand and contract relative to the concrete without buckling. The is also beneficial when used with a replaceable tile in that the tray keeps the tile from coming directly in contact with the concrete, making the tile easier to remove. Moreover, because the tile is not embedded directly in the concrete, underside protrusions can be any shape, including wider at their lowest point, without compromising replaceability. The isolation tray may be made from a variety of materials, and in particular, could be made from a material whose thermal expansion characteristics mimic those of concrete.

Protecting Detectable Warnings

A second problem with some detectable warning tiles is damage to the truncated domes when a snow plow or shovel is scraped across the top of the tile. Where detectable warnings protrude above the level of the surrounding walking surface, a plow or shovel that travels along the walking surface may shear off or otherwise damage a truncated dome. FIG. 1A shows a detectable warning tile with an upward facing lip to address this problem. The upper surface of the tile is generally flat, punctuated by truncated domes. The lip protrudes upward from the tile to a greater height than the truncated domes. In this way, the blade of a snow plow or shovel may ride along the upper lip without ever contacting the truncated domes. Thus the lip protects the truncated domes from damage. Where tiles are intended to be installed adjacent to one another, the upper lip may extend only along some sides of the tile. In that way, an upper lip can be formed around a collection of tiles with no upper lip along the internal seams between tiles. FIG. 1A shows a tile with an upper lip along only three of its four sides.

Cleaning

Figure 4A:
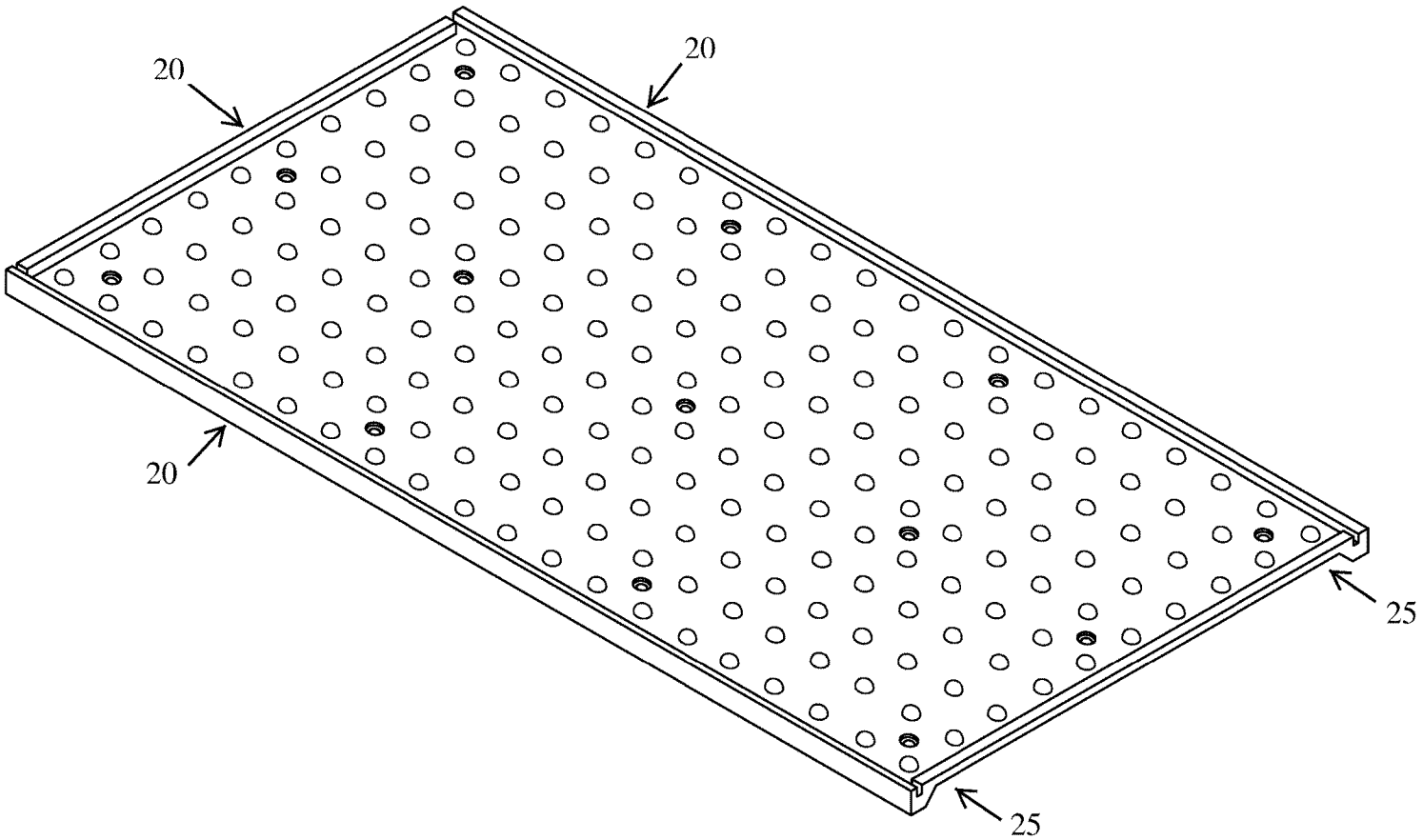
FIG. 4A is a schematic picture of a replaceable detectable warning tile with a protective upper lip designed to promote self-cleaning.
Figure 4B:
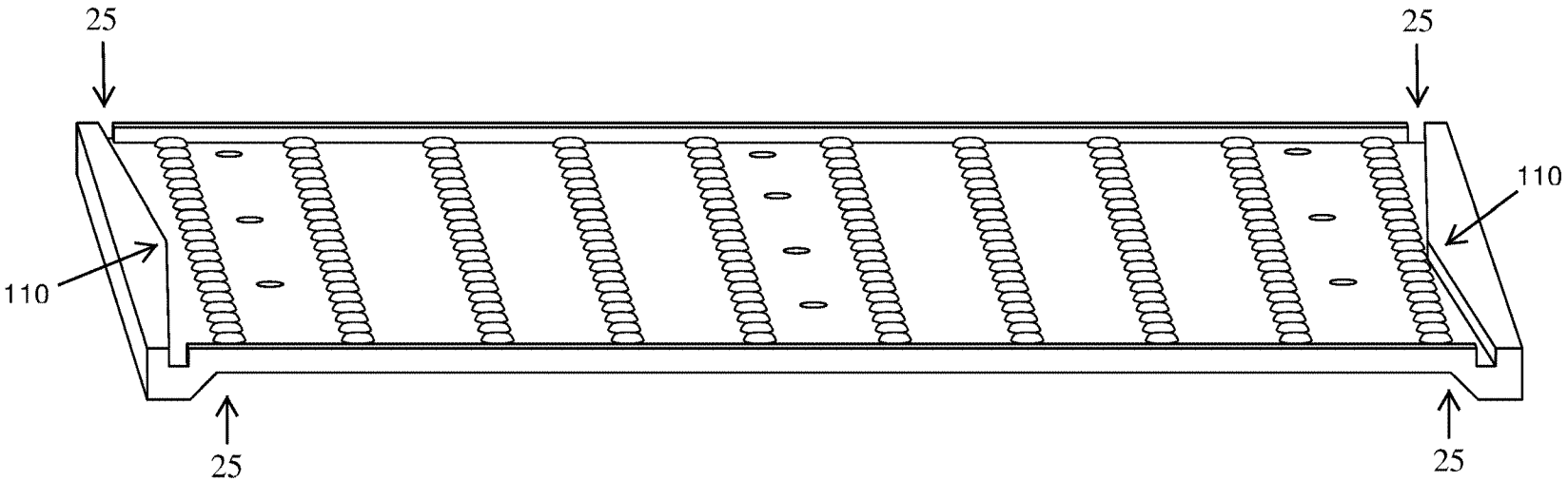
FIG. 4B is a schematic picture of the same tile depicted in FIG. 4A looking along the long axis of the tile to emphasize the triangular shape of the upper lip.
Figure 4C:
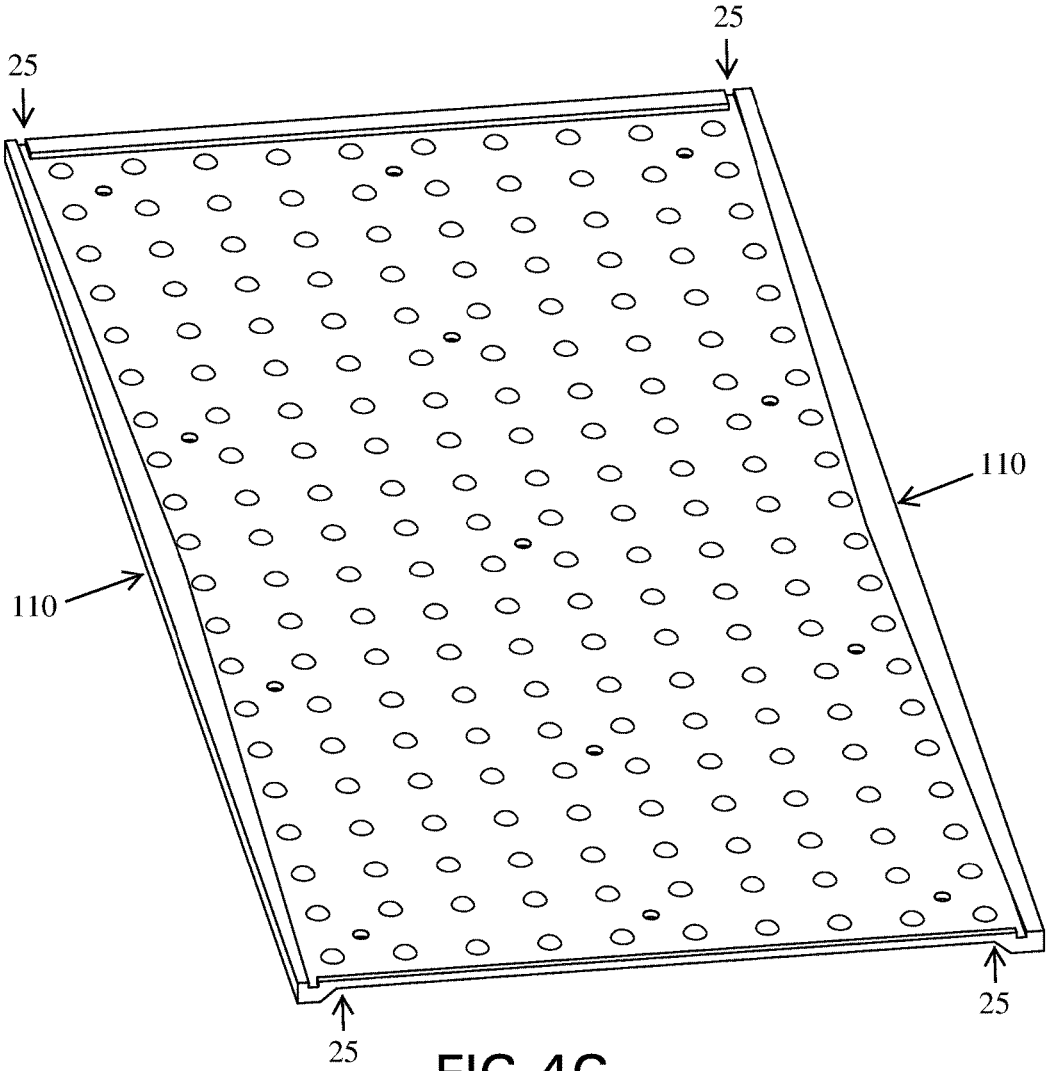
FIG. 4C is a schematic picture of the same tile depicted in FIG. 4A.

A third problem with some detectable warning tiles is the difficulty of cleaning the tile. FIG. 4A shows a detectable warning tile designed to be at least partially self-cleaning. The unit has an upper lip to protect the detectable warnings from snow plows as described above. In this case, the upper lip is broken at locations on the long sides of the tile, near the corner. In this way the upper lip defines one or more openings. The upper lip along the long sides of the tile is also wider at the center than at the corners. In FIGS. 4A-4C the long sides of the upper lip have triangular peaks, but many such shapes will suffice. When such a tile is installed on a slope, for example in a curb ramp, or curb cut, with one long side below the other long side, debris will roll or flow down the slope, hit the lip on the lower edge of the tile, then roll or flow along the sloped lip down to the corner where it can be channeled away through the break in the lip. In this way, the upper lip can be shaped to promote self-cleaning when installed on a slope. Although only the downhill side of the tile needs to have to above-described shape and openings to work as described, the upper lip as shown in FIGS. 4A-4C is symmetrical for ease of installation, so that the tile can be installed with either long edge at the top or bottom of the slope.

Venting

Wet-set tiles are installed by pressing the tile down into wet concrete. If the tile has downward projections, such as flanges or ribs on the underside, depending on the geometry of those projections, air may get trapped between the wet concrete and the tile. A number of different mechanisms can be used to allow such air to vent from underneath the tile. For example, if the only downward protrusions are flanges on two sides and there are other sides with no flanges, air will escape along the sides that have no flange. FIG. 1D shows the underside of a tile with a series of ribs. Because of the arrangement of the ribs, even when pressed into wet concrete, the tile creates no isolated pockets of air that cannot escape via the sides with no flanges.

Figure 5A:
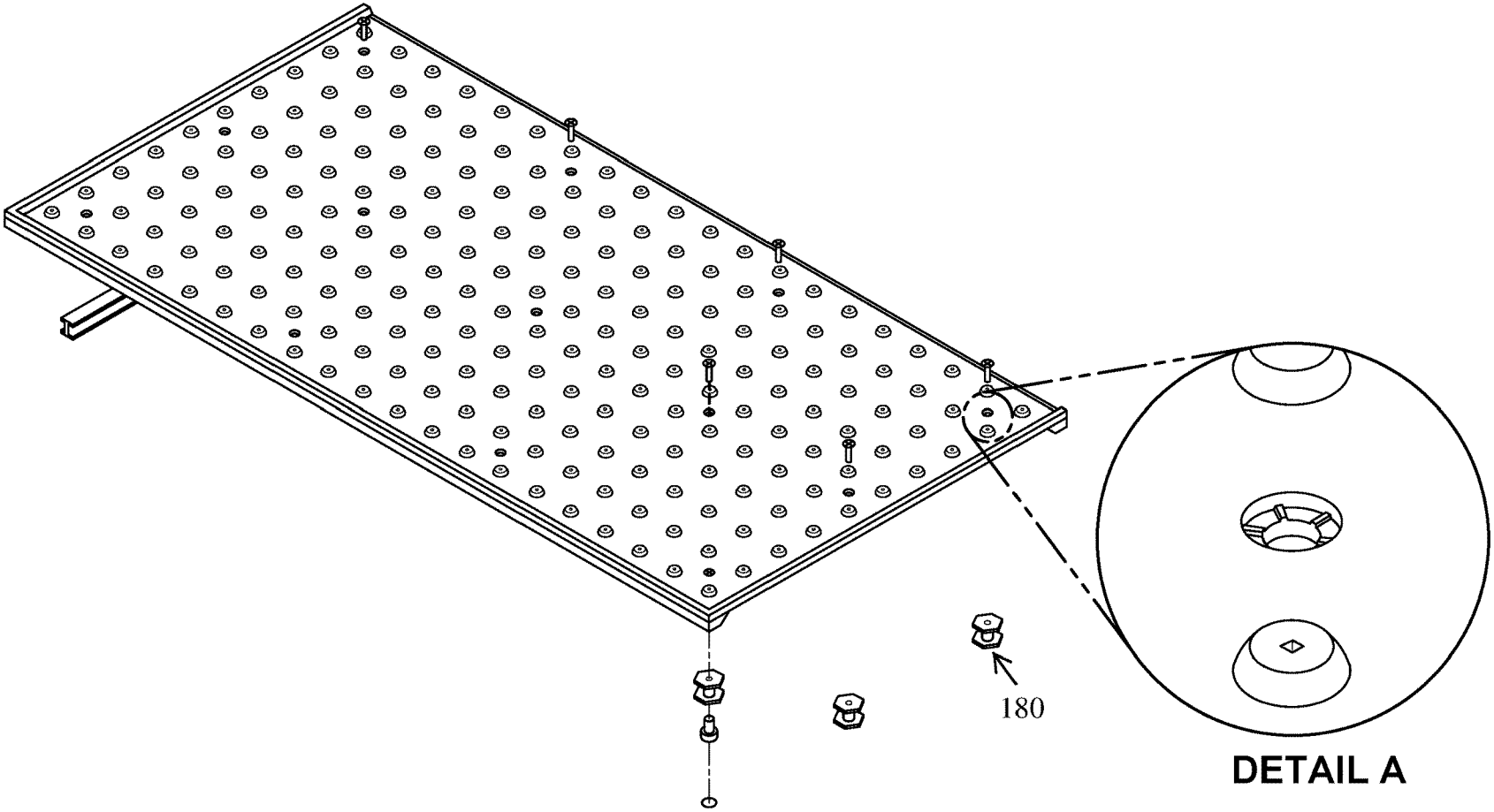
FIG. 5A is a schematic picture of a replaceable detectable warning tile with features designed to allow venting from below to above the tile.
Figure 5B:
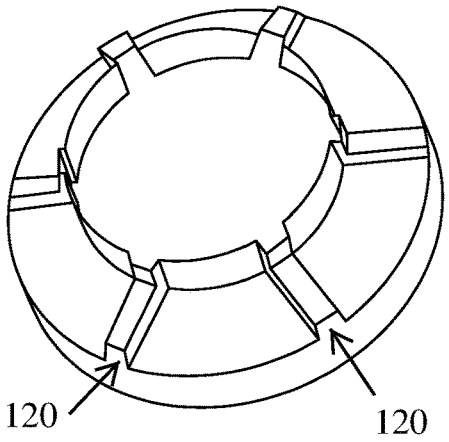
FIG. 5B is a close up schematic picture of the tile depicted in FIG. 5A.

Venting can also be achieved by leaving room for air to flow around the fasteners. FIG. 5A shows two ways of allowing venting around the fasteners. Detail A of FIG. 5A shows a hole through the tile. The fastener passes through the hole and attaches to the anchor. As the fastener is tightened in the anchor, the anchor becomes held to the tile. But the hole shown in Detail A is not merely a countersink to allow the screw head to be recessed. The horizontal and vertical surfaces of the hole include channels that allow air to flow from below the tile to above the tile, even when a screw is seated in the countersink. When the screw is tightened down, it seats against the horizontal surface of the countersink, leaving channels underneath the screw that continue to the underside of the tile. This is shown in more detail in FIG. 5B.

Figure 5C:
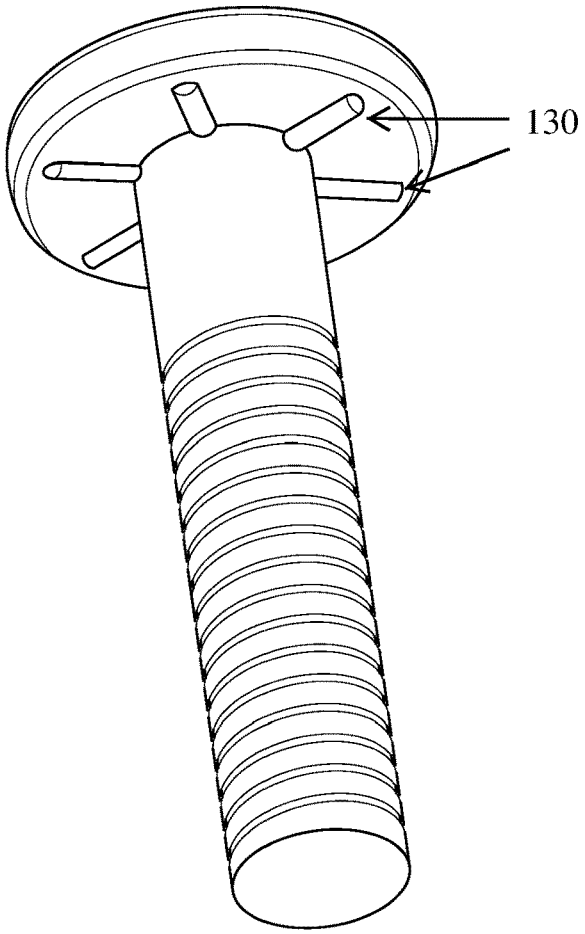
FIG. 5C is a schematic of a screw with ribs on the underside of the screw head.

FIG. 5C shows a screw with protruding ribs on the underside of the screw head. This screw similarly serves to allow venting around the screw from below to above the tile. When the screw is tightened down against the tile, the ribs contact the horizontal surface of the countersink, leaving the rest of the screw head removed from the tile. As long as the screw does not completely fill the through hole and the head does not completely fill the countersink, the ribbed screw will thus leave openings for air to flow from below the tile to above the tile.

Any arrangement of fastener and through hole that leaves space for air to vent could be effective to allow venting around the fastener.

Figure 5D:
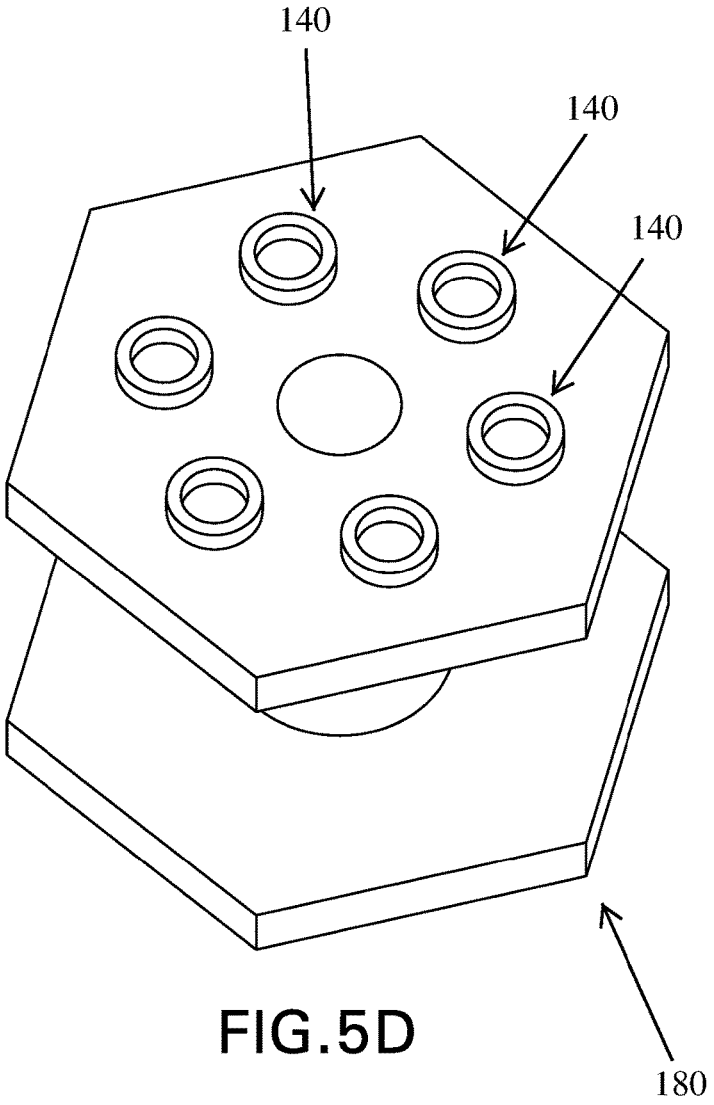
FIG. 5D is a schematic of an anchor that allows venting.

The fasteners attach to anchors that seat tightly against the underside of the tile. In order for air to flow around the fastener, the anchor cannot be allowed to completely block the hole. FIG. 5D shows an anchor with six circular bosses that allow the anchor to stand off from the underside of the tile even when firmly attached to the tile. An anchor like the one in FIG. 5D can be used with any combination of fasteners and holes that allows for venting.

We claim:

1. A detectable warning tile comprising:

a body having a plurality of edges and an upper surface, the body including at least three adjacent edges;

a plurality of detectable warnings on the upper surface; and an upper lip along the at least three adjacent edges;

wherein the upper lip extends along a first edge of the at least three adjacent edges to define a first edge length, along a second edge of the at least three adjacent edges to define a second edge length, and along a third edge of the at least three adjacent edges to define a third edge length;

the upper lip having at least one break therein disposed proximate the first edge and the second edge, and has a triangular peak at a midpoint of the first edge, the triangular peak extending inwardly towards a center of the tile; and wherein the detectable warnings rise a specified height off the upper surface, and the upper lip rises a greater height off the upper surface.

2. The tile of claim 1, wherein the upper lip has a first width at the midpoint of the first edge, the upper lip has a second width at an endpoint of the first edge, the first width greater than the second width.

3. The tile of claim 2, wherein the upper lip is narrowest adjacent to the at least one break.

4. The tile of claim 1, wherein the upper lip and a downwardly depending flange are vertically aligned along a first edge of the tile.

5. The tile of claim 1, wherein the upper lip along the first edge is disposed opposite the third edge.

6. The tile of claim 1, wherein the upper lip along the second edge is disposed opposite a fourth edge of the body.

7. The tile of claim 1, wherein the upper lip has a constant width along the second edge.

8. The tile of claim 1, wherein the body has a fourth edge, and an upper lip having a constant width along the fourth edge.

9. The tile of claim 1, wherein the upper lip includes at least one break disposed proximate the second edge and the third edge of the body.

* * * * *